US008605909B2

(12) United States Patent
Emerit et al.

(10) Patent No.: US 8,605,909 B2
(45) Date of Patent: Dec. 10, 2013

(54) METHOD AND DEVICE FOR EFFICIENT BINAURAL SOUND SPATIALIZATION IN THE TRANSFORMED DOMAIN

(75) Inventors: Marc Emerit, Rennes (FR); Pierrick Philippe, Melese (FR); David Virette, Pleumeur Bodou (FR)

(73) Assignee: France Telecom, Paris (FR)

( * ) Notice: Subject to any disclaimer, the term of this patent is extended or adjusted under 35 U.S.C. 154(b) by 1166 days.

(21) Appl. No.: 12/225,677

(22) PCT Filed: Mar. 8, 2007

(86) PCT No.: PCT/FR2007/050894

§ 371 (c)(1),
(2), (4) Date: Sep. 26, 2008

(87) PCT Pub. No.: WO2007/110519

PCT Pub. Date: Oct. 4, 2007

(65) Prior Publication Data

US 2009/0232317 A1 Sep. 17, 2009

(30) Foreign Application Priority Data

Mar. 28, 2006 (FR) ..... 06 02685

(51) Int. Cl.
*H04R 5/00* (2006.01)

(52) U.S. Cl.
USPC ..... 381/17; 381/22; 381/23; 381/94.3; 381/106

(58) Field of Classification Search
USPC ..... 381/17, 22, 23, 94.3, 103, 106
See application file for complete search history.

(56) References Cited

U.S. PATENT DOCUMENTS

| | | | | |
|---|---|---|---|---|
| 2006/0093152 | A1* | 5/2006 | Thompson et al. | 381/17 |
| 2006/0198542 | A1 | 9/2006 | Benjelloun Touimi et al. | |
| 2008/0025519 | A1* | 1/2008 | Yu et al. | 381/17 |

FOREIGN PATENT DOCUMENTS

| | | |
|---|---|---|
| JP | 2001-306097 | 11/2001 |
| JP | 2005-533271 | 11/2005 |
| JP | 2008-505368 | 2/2008 |
| WO | WO 2004/008806 | 1/2004 |
| WO | WO 2005/094125 A1 | 10/2005 |
| WO | WO 2006/005390 | 1/2006 |

OTHER PUBLICATIONS

Kulkarni et al.; "On the Minium-Phase Approximation of Head-Related Transfer Functions", (Oct. 15, 1995), Application of signal processing to audio and acoustics, 1995, IEEE ASSP Workshop On New Paltz, NY, USA Oct. 15-18, 1995, New York, NY, US, pp. 84-87, XP010154639.

* cited by examiner

*Primary Examiner* — S. V. Clark
*Assistant Examiner* — Jesse Y Miyoshi
(74) *Attorney, Agent, or Firm* — Knobbe Martens Olson & Bear LLP

(57) ABSTRACT

The invention concerns a method and a system for sound spatialization of a first set of not less than one of the audio channels encoded on of a number of frequency subbands (SBk) and decoded in a transformed domain (Fl, C, Fr, Sr, SI, Ife) into a second set of not less than two (Bl, Br) sound channels in the time domain, from modelling filters converted into a gain and a delay applicable in the transformed domain involving: filtering (A) through equalization, subband delay of the signal by applying at least one gain and one delay to generate from each of said encoded channels an equalized and delayed component; adding (B) a subset of equalized and delayed signals to create a number of filtered signals corresponding to not less than two; synthesizing (C) each of said filtered signals to obtain the second set of not less than two reproduction sound channels (Bl, Br) in the time domain.

11 Claims, 8 Drawing Sheets

METHOD AND DEVICE FOR EFFICIENT BINAURAL SOUND SPATIALIZATION IN THE TRANSFORMED DOMAIN

BACKGROUND OF THE INVENTION

This application is a national stage entry of International Application No. PCT/FR2007/050894, filed on Mar. 8, 2007, and claims priority to French Application No. 06 02685, filed Mar. 28, 2006, both of which are hereby incorporated by reference as if fully set forth herein in their entireties.

The invention relates to spatialization, known as 3D-rendered sound, of compressed audio signals.

Such an operation is for example carried out during the decompression of a compressed 3D audio signal for example, represented over a certain number of channels, into a different number of channels, two for example, in order to allow the reproduction of the 3D audio effects on a pair of headphones.

Thus, the term "binaural" is aimed at the reproduction on a pair of stereophonic headphones of an audio signal but still with spatialization effects. The invention is not however limited to the aforementioned technique and is notably applicable to techniques derived from the "binaural" technique, such as the reproduction techniques known as TRANSAURAL®, in other words on remote loudspeakers. TRANSAURAL® is a commercial trademark of the company COOPER BAUCK CORPORATION. Such techniques can then use a "cross-talk cancellation" technique, which consists in eliminating crossed acoustic channels, in such a manner that a sound, thus processed then emitted by the loudspeakers, may only be heard by one of the two ears of a listener.

Consequently, the invention also relates to the transmission and to the reproduction of multichannel audio signals and to their conversion to a reproduction device, transducer, imposed by the equipment of a user. This is for example the case for the reproduction of a 5.1 sound scene by a pair of audio headphones, or by a pair of loudspeakers.

The invention also relates to the reproduction, within the framework of a game or video recording for example, of one or more sound samples stored in files, with a view to their spatialization.

Various approaches have been proposed amongst the techniques known in the field of binaural sound spatialization.

In particular, dual-channel binaural synthesis consists, with reference to FIG. 1*a*, in filtering the signal from the various sound sources $S_i$ that it is desired to position, upon reproduction, at a position in space, by means of left HRTF-l and right HRTF-r acoustic transfer functions in the frequency domain corresponding to the appropriate direction, defined in polar coordinates $(\theta_1, \phi_1)$. The aforementioned transfer functions HRTF, abbreviation for "Head-Related Transfer Functions", are the acoustic transfer functions of the head of the listener between the positions in space and the auditory canal. In addition, their temporal figure is denoted "HRIR", abbreviation for "Head-Related Impulse Response". These functions may also comprise a room effect.

For each sound source $S_i$, two signals, left and right, are obtained which are then added to the left and right signals coming from the spatialization of the other sound sources, in order to finally yield the signals L and R transmitted to the left and right ears of the listener.

The number of filters, or transfer functions, required is then 2.N for static binaural synthesis and 4.N for dynamic binaural synthesis, where N denotes the number of sound sources or audio streams to be spatialized.

Studies, entitled "*A model of head-related transfer functions based on principal components analysis and minimum-phase reconstruction*" conducted by D. Kistler and F. L. Wightman, published in J. Acoust. Soc. Am. 91(3): pp. 1637-1647 (1992) and by A. Kulkami 1995 "*IEEE ASSP Workshop on Applications of Signal Processing to Audio and Acoustics*" IEEE catalog number: 95TH8144, have enabled it to verify that the phases of the HRTF can be decomposed into the sum of two terms, one corresponding to the interaural delay and the other equal to the minimum phase associated with the modulus of the HRTF.

Thus, for an HRTF transfer function expressed in the form:

$$H(f)=|H(f)|e^{-j\phi(f)}$$

$$\phi(f)=\phi\text{delay}(f)+\phi\text{min}(f)$$

$\phi\text{delay}(f)=2\pi f\tau$ corresponds to the interaural delay;

$\phi\text{min}(f)=H(\log(|H(f)|))$ is the minimum phase associated with the modulus of the filter H.

The implementation of binaural filters is generally in the form of two minimum-phase filters and of a pure delay, corresponding to the difference of the left and right delays applied to the ear furthest away from the source. This delay is generally implemented by means of a delay line.

The minimum-phase filter is a finite pulse response filter and may be applied in the time or frequency domain. Infinite pulse-response filters may be sought in order to approximate the modulus of the minimum-phase HRTF filters.

As far as the binauralization is concerned, with reference to FIG. 1*b*, the situation is the non-limiting framework of a sound scene spatialized in 5.1 mode, with a view to the reproduction of the latter on the audio headphones of a human being HB.

Five loudspeakers C: Center, Lf: Left front, Rf: Right front, Sl: Surround left, Sr: Surround right, each produce a sound which is heard by the human being HB on the two receivers that are his ears. The transformations undergone by the sound are modeled by a filtering function representing the modification that this sound undergoes during its propagation between the loudspeaker which reproduces this sound and a given ear.

In particular, the sound emanating from the loudspeaker Lf affects the left ear LE via an HRTF filter A, but this same sound reaches the right ear RE modified by an HRTF filter B.

The position of the loudspeakers with respect to the aforementioned individual HB may be symmetrical or otherwise.

Each ear therefore receives the contribution from the 5 loudspeakers in the form modeled hereinafter:

Left ear LE: Bl=ALf+CC+BRf+DSl+ESr,

Right ear RE: Br=ARf+CC+BLf+DSr+ESl, where Bl is the binauralized signal for the left ear LE and Br is the binauralized signal for the right ear RE.

The filters A, B, C, D and E are most commonly modeled by linear digital filters and, in the configuration shown in FIG. 1*b*, 10 filtering functions therefore need to be applied, which can be reduced to 5 in view of the symmetries.

In a manner known per se, the aforementioned filtering operations may be carried out in the frequency domain, for example by means of a fast convolution executed in the Fourier domain. An FFT, or Fast Fourier Transform, is then used in order to carry out the binauralization efficiently.

The HRTF filters A, B, C, D and E may be simplified in the form of a frequency equalizer and a delay. The HRTF filter A may be embodied in the form of a simple equalizer, since this is a direct path, whereas the HRTF filter B includes an additional delay. Conventionally, the HRTF filters may be decomposed into a minimum-phase filter and a pure delay. The delay for the ear closest to the source may be taken equal to zero.

The operation for reconstruction by spatial decoding of a 3D audio sound scene, using a reduced number of transmitted channels, such as is shown in FIG. 1*c*, is also known from the prior art. The configuration shown in FIG. 1*c* is that relating to the decoding of a coded audio channel having localization parameters in the frequency domain, in order to reconstruct a 5.1 spatialized sound scene.

The aforementioned reconstruction is carried out by a spatial decoder by frequency sub-bands, such as is shown in FIG. 1*c*. The coded audio signal m undergoes 5 spatialization processing steps, which are controlled by complex spatialization parameters or coefficients CLD and ICC calculated by the encoder and which allow, through decorrelation and gain correction operations, the sound scene composed of six channels, the five channels shown in FIG. 1*b* to which is added a low-frequency effect channel lfe, to be reconstructed in a realistic manner.

When it is desired to carry out a binauralization of the audio channels coming from a spatial decoder such as is shown in FIG. 1*c*, we are in fact limited, at the present time, to implementing a processing method according to the scheme shown in FIG. 1*d*.

With reference to the aforementioned scheme, it seems necessary to carry out the transformation of the audio channels, which are available in the time domain, before carrying out the binauralization of the signal. This operation for returning to the time domain is symbolized by the synthesizer blocks "Synth" which perform the frequency-time transformation operation for each of the channels coming from the spatial decoder (SD). The filtering by the HRTF filters can then be carried out by the filters A, B, C, D, E, with or without application of the equalized scheme, corresponding to a conventional filtering.

One variant for binauralization of the audio channels from a spatial decoder can also consist, as is shown in FIG. 1*e*, in converting each audio channel delivered by the audio decoder in the time domain by a synthesizer "Synth", then in executing the spatial decoding and binauralization operation, or spatialization, in the Fourier frequency domain, after transformation by FFT.

In this scenario, each module OTT, corresponding to a matrix of decoding coefficients, must then be converted in the Fourier domain, at the expense of an approximation, since the operations are not carried out within the same domain. Moreover, the complexity is further increased, since the synthesizing operation "Synth" is followed by three FFT transformations.

Thus, in order to binauralize a sound scene coming from a spatial decoder, there exist few other possibilities but to carry out:

- either 6 time-frequency transformations, if it is desired to carry out the binauralization outside of the spatial decoder;
- or a synthesizing operation followed by 3 FFT Fourier transformations, if it is desired to carry out the operation in the FFT domain.

One other solution could also be used if need be that consists in carrying out the HRTF filtering directly in the domain of the sub-bands, as is shown in FIG. 1*f*.

However, in this scenario, the HRTF filtering operations are complex to apply, since the latter impose the use of sub-band filters whose minimum length is fixed and which must take into account the phenomenon of spectral aliasing of the sub-bands.

The saving achieved by the reduction in transformation operations is negatively counterbalanced by the dramatic increase in the number of operations required for the filtering, owing to the execution of these operations in the PQMF, or Pseudo-Quadrature Mirror Filter, domain.

The objective of the present invention is to overcome the numerous drawbacks of the aforementioned prior art techniques for sound spatialization of 3D audio scenes, and notably for transauralization or binauralization of 3D audio scenes.

In particular, one objective of the present invention is the execution of a specific filtering of spatially coded audio signals or channels in the domain of the frequency sub-bands of a spatial decoding, in order to limit the number of transformation pairs, while at the same time reducing the filtering operations to the minimum, but conserving a good quality of source spatialization, notably in transauralization or binauralization.

According to one particularly noteworthy aspect of the present invention, the execution of the aforementioned specific filtering relies on rendering the spatialization, transaural or binaural filters in the form of an equalizer-delay, for direct application of a filtering by equalization-delay in the domain of the sub-bands.

Another objective of the present invention is the achievement of a 3D rendering quality very close to that obtained using modeling filters such as original HRTF filters, by the simple addition of a transaural spatial processing of very low complexity, following a conventional spatial decoding in the transformed domain.

A final objective of the present invention is a novel source spatialization technique applicable not only to the transaural or binaural rendering of a monophonic sound, but also to several monophonic sounds and notably to the multiple channels of stereo sounds in modes 5.1, 6.1, 7.1, 8.1 or higher.

SUMMARY OF THE INVENTION

One subject of the present invention is thus a method for sound spatialization of an audio scene comprising a first set, comprising a number, greater than or equal to unity, of audio channels spatially coded over a given number of frequency sub-bands, and decoded in a transformed domain, into a second set comprising a number, greater than or equal to two, of audio channels for reproduction in the time domain, using filters modeling the acoustic propagation of the audio signals of the first set of channels.

According to the invention, this method is noteworthy in that, for each modeling filter converted into the form of at least one gain and of a delay applicable in the transformed domain, it consists in carrying out, for each frequency sub-band of the transformed domain, at least:

- a filtering by equalization-delay of the signal in sub-band, by application of a gain and a delay, respectively, on the sub-band signal, in order to generate, starting from the spatially coded channels, an equalized component delayed by a given value in the frequency sub-band in question;
- an addition of a sub-set of equalized and delayed components, in order to create a number of filtered signals in the transformed domain corresponding to the number in said second set, greater than or equal to two, of audio channels for reproduction in the time domain;
- a synthesis of each of the filtered signals in the transformed domain by a synthesizing filter, in order to obtain the second set with a number greater than or equal to two of audio signals for reproduction in the time domain.

The method, subject of the invention, is also noteworthy in that the filtering by equalization-delay of the sub-band signal includes at least the application of a phase shift and, where appropriate, of a pure delay by storage, for at least one of the frequency sub-bands.

The method, subject of the invention, is also noteworthy in that it includes filtering by equalization-delay in a hybrid transformed domain, comprising an additional step for frequency division into additional sub-bands, with or without decimation.

The method, subject of the invention, is lastly noteworthy in that, in order to convert each modeling filter into a gain value and, respectively, a delay value, in the transformed domain, it consists at least in associating, as gain value, with each sub-band a real value defined as the mean of the modulus of the modeling filter within this sub-band and in associating, as delay value, with each sub-band a delay value corresponding to the reception delay between the left ear and the right ear for various positions.

In a correlated manner, another subject of the present invention is a device for sound spatialization of an audio scene comprising a first set, comprising a number, greater than or equal to unity, of audio channels spatially coded over a given number of frequency sub-bands, and decoded in a transformed domain, into a second set comprising a number, greater than or equal to two, of audio channels for reproduction in the time domain, using filters modeling the acoustic propagation of the audio signals of the first sub-set of channels.

According to the invention, this device is noteworthy in that, for each frequency sub-band of a spatial decoder, in the transformed domain, this device comprises, aside from this spatial decoder:

- a module for filtering by equalization-delay of the signal in sub-band by application of a gain and a delay, respectively, on the sub-band signal, in order to generate from each of the spatially coded audio channels a component equalized and delayed by a given delay value in the frequency sub-band in question;
- a module for addition of a sub-set of equalized and delayed components, in order to create a number of filtered signals in the transformed domain corresponding to the number in the second set greater than or equal to two of audio channels for reproduction in the time domain;
- a module for synthesizing each of the filtered signals in the transformed domain, in order to obtain the second set comprising a number greater than or equal to two of the audio channels for reproduction in the time domain.

The method and the device, subjects of the invention, have applications in the hi-fi audio and/or video electronics industry, and in the industry for audio-video games executed locally or on-line.

BRIEF DESCRIPTION OF THE DRAWINGS

They will be better understood upon reading the description and from the observation of the appended drawings in which, aside from FIGS. 1*a* to 1*f* relating to the prior art.

DESCRIPTION OF PREFERRED EMBODIMENTS

Figure 2A:
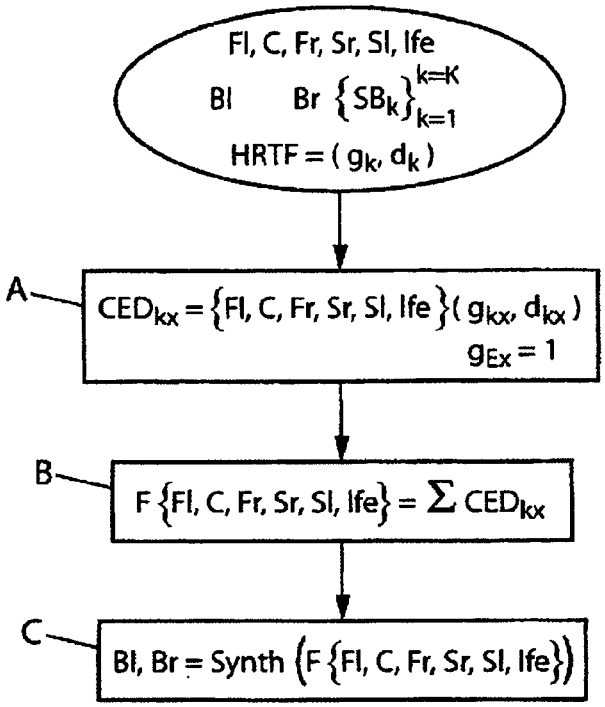
FIG. 2*a* shows an illustrative flow diagram of the implementation steps for the sound spatialization method, subject of the invention.

A more detailed description of the method for sound spatialization of an audio scene according to the subject of the present invention will now be presented in conjunction with FIG. 2*a* and the following figures.

The method, subject of the invention, is applicable to an audio scene such as a 3D audio scene represented by a first set comprising a number N, greater than or equal to unity, $N \geq 1$, of audio channels spatially coded over a given number of frequency sub-bands and decoded in a transformed domain.

The transformed domain is understood to mean a transformed frequency domain such as Fourier domain, PQMF domain or any hybrid domain coming from the latter by creation of additional sub-bands of frequencies, subjected to a process of time decimation or otherwise.

Consequently, the spatially coded audio channels forming the first set N of channels are represented in a non-limiting manner by the channels Fl, Fr, Sr, Sl, C, lfe previously described in the description and corresponding to a decoding mode of a 3D audio scene in the corresponding transformed domain, as was previously described in the description. This mode is none other than the aforementioned 5.1 mode.

In addition, these signals are decoded in the aforementioned transformed domain according to a given number of sub-bands specific to the decoding, the set of the sub-bands being denoted $(SB_k)_{k=1}^{k=K}$, where k denotes the rank of the sub-band in question.

Figure 1A:
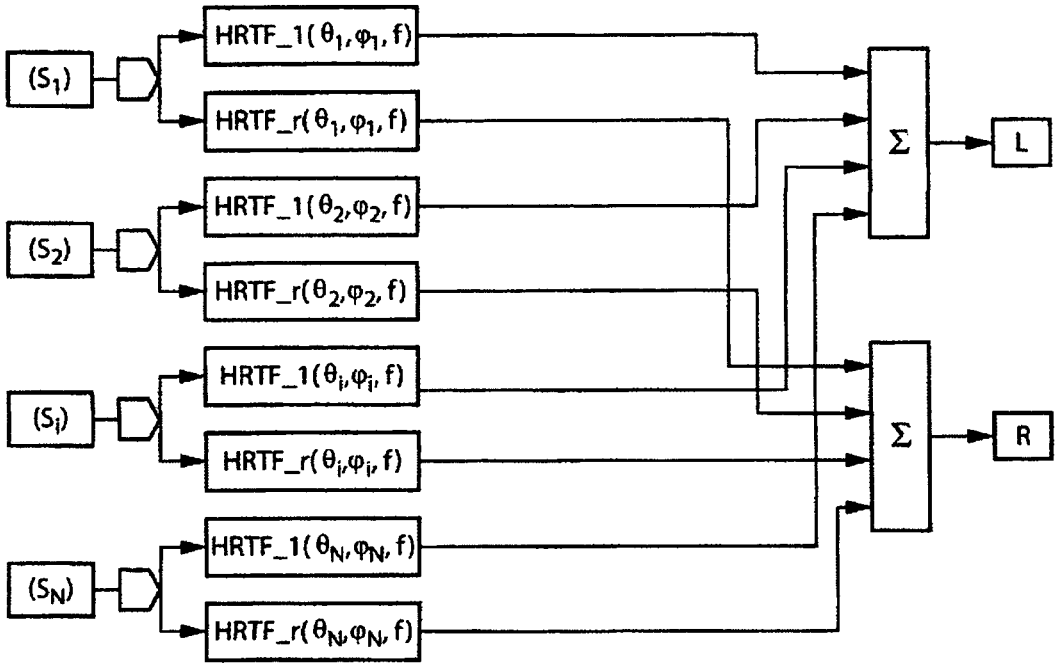
FIG. 1a (PRIOR ART)
Figure 1B:
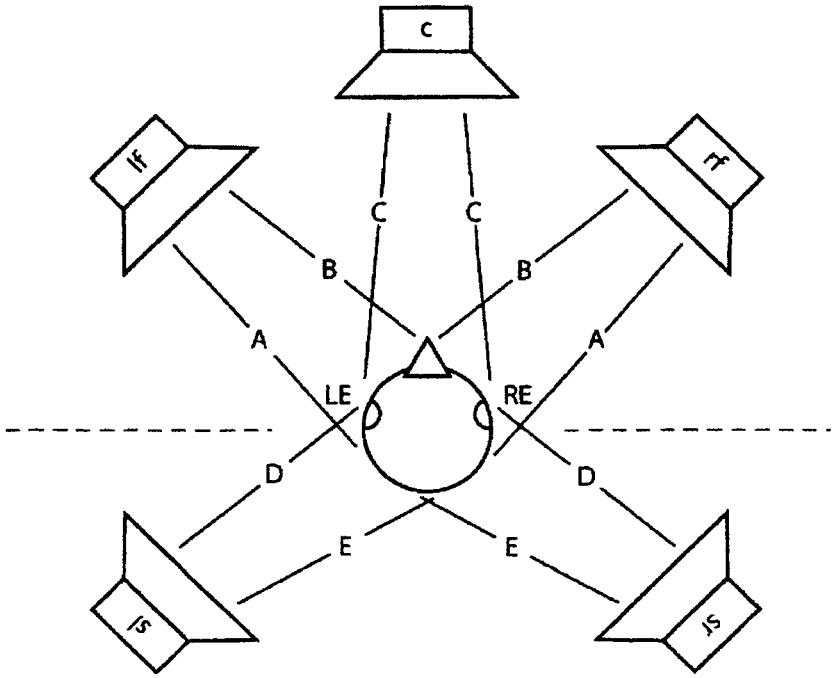
FIG. 1b (PRIOR ART)

The method, subject of the invention, allows the set of the aforementioned spatially coded audio channels to be transformed into a second set comprising a number, greater than or equal to two, of audio channels for reproduction in the time domain, the reproduction audio channels being denoted Bl and Br for the left and right binaural channels, respectively, in a non-limiting manner in the framework of FIG. 2*a*. It will be understood, in particular, that instead and in place of two binaural channels, the method, subject of the invention, is applicable to any number of channels greater than two, allowing for example the sound reproduction in real time of the 3D audio scene, as is shown and described in the description in conjunction with FIG. 1*b*.

According to one noteworthy aspect of the method, subject of the invention, the latter is implemented using filters modeling the acoustic propagation of the audio signals of the first set of spatially coded audio channels, taking into account a conversion in the form of at least one gain and of a delay applicable in the transformed domain, as will be described later on in the description. In a non-limiting manner, the modeling filters will be denoted as HRTF filters in the remainder of the description.

The aforementioned conversion is denoted for each HRTF filter considered for a sub-band $SB_k$ of rank k to establish a gain value $g_k$ and corresponding delay value $d_k$, the preceding conversion then being denoted, as is shown in FIG. 2*a*, $HRTF \equiv (g_k, d_k)$.

In view of the aforementioned conversion, the method, subject of the invention, consists, for each frequency sub-band of the transformed domain of rank k, in performing, at the step A, a filtering by equalization-delay of the sub-band signal by application of a gain $g_k$ and of a delay $d_k$, respectively, to the sub-band signal, in order to generate from the aforementioned spatially coded channels, in other words the channels Fl, C, Fr, Sr, Sl and lfe, a component equalized and delayed with a given delay value in the frequency sub-band $SB_k$ of rank k in question.

In FIG. 2*a*, the filtering operation by equalization-delay is denoted symbolically $CED_{kx}$={Fl,C,Fr,Sr,Sl,lfe} ($g_{kx}$, $d_{kx}$).

In the aforementioned symbolic equation, $CED_{kx}$ denotes each equalized and delayed component obtained by application of the gain $g_{kx}$ and of the delay $d_{kx}$ on each of the spatially coded audio channels, in other words the channels Fl,C,Fr, Sr,Sl,lfe.

Consequently and in the aforementioned symbolic equation, x, for the corresponding sub-band of rank k, can actually take the values Fl,C,Fr,Sr,Sl,lfe.

The step A is then followed in the transformed domain by a step B for addition of a sub-set of equalized and delayed components in order to create a number of filtered signals in the transformed domain corresponding to the number N', greater than or equal to 2, of the second set of audio channels for reproduction in the time domain.

At the step B in FIG. 2*a*, the addition operation is given by the symbolic equation:

$$F\{Fl,C,Fr,Sr,Sl,lfe\}=\Sigma CED_{kx}.$$

In the aforementioned symbolic equation, F{Fl,C,Fr,Sr,Sl, lfe} denotes the sub-set of the filtered signals in the transformed domain obtained by summation of a sub-set of equalized and delayed components $CED_{kx}$.

By way of a non-limiting and instructive example, for a first set comprising a number of spatially coded audio channels, N=6, corresponding to a 5.1 mode, the sub-set of equalized and delayed components can consist in adding five of these equalized and delayed components for each ear in order to obtain the number N', equal to 2, of filtered signals in the transformed domain, as will be described in more detail later on in the description.

The aforementioned addition step B is then followed by a step C for synthesizing each of the filtered signals in the transformed domain by a synthesizing filter in order to obtain the second set with a number N', greater than or equal to two, of audio signals for reproduction in the time domain.

At the step C in FIG. 2*a*, the corresponding synthesizing operation is represented by the symbolic equation:

$$Bl,Br=\mathrm{Synth}(F\{Fl,C,Fr,Sr,Sl,lfe\})$$

Generally speaking, it is stated that the method, subject of the invention, can be applied to any 3D audio scene composed of N, varying between 1 and infinity, of spatially coded audio paths or channels into N', varying from 2 to infinity, reproduction audio channels.

As far as the summation step represented at the step B in FIG. 2*a* is concerned, it is stated that the latter more specifically consists in adding a sub-assembly of components differently delayed by the various delays in order to generate the N' components for each sub-band.

More specifically, it is stated that the filtering by equalization-delay of the sub-band signal includes at least the application of a phase-shift completed, as the case may be, by a pure delay by storage, for at least one of the frequency sub-bands.

The notion of application of a pure delay is symbolized at the step A in FIG. 2*a* by the equation $g_{Ex}=1$, which represents the absence of equalization for the set of the audio channels of index x within the sub-band of rank k=E, the value 1 indicating transmission without modification of the amplitude of each of the spatially coded audio channels.

The transformed domain can correspond, as was previously mentioned in the description, to a hybrid transformed domain as will be described in conjunction with FIG. 2*b* in the case where no frequency decimation is applied in the corresponding sub-band.

Figure 2B:
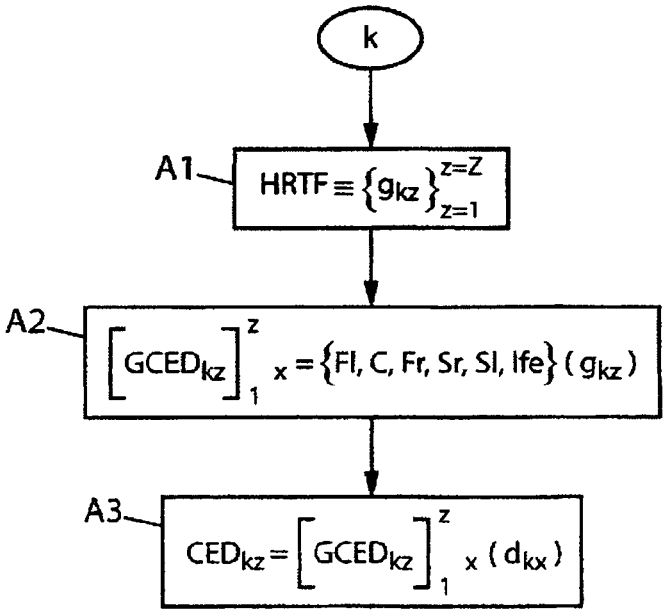
FIG. 2*b* shows, by way of illustration, one variant embodiment of the method, subject of the invention, shown in FIG. 2*a*, obtained by creation of additional sub-bands, in the absence of decimation.

With reference to the aforementioned FIG. 2*b*, the filtering by equalization-delay shown as the step A in FIG. 2*a* is then executed in three sub-steps A1,A2,A3 shown in FIG. 2*b*.

Under these conditions, the step A comprises an additional step for frequency division into additional sub-bands without decimation, in order to increase the number of gain values applied and thus the precision in frequency, followed by a step for recombining of additional sub-bands, to which the aforementioned gain values have been applied.

The frequency division then recombining operations are shown at the sub-steps $A_1$ and $A_2$ in FIG. 2*b*.

The frequency division step is represented at the sub-step $A_1$ by the equation:

$$HRTF=\{g_{kz},d_{kz}\}_{z=1}^{z=Z}.$$

The recombining step is represented at the sub-step $A_2$ by the equation:

$$[GCEB_{kz}]_1^z x=\{Fl,C,Fl,Sr,Sl,lfe\}(g_{kz})$$

At the sub-step $A_1$, it will be understood that the values of gain and of delay for the sub-band of rank k in question are subdivided into Z corresponding values of gain, one gain value $g_{kz}$ for each additional sub-band and at the sub-step $\mathbf{1}_2$, it will be understood that the recombining of the additional sub-bands is carried out using the corresponding coded audio channels for the corresponding index x to which the gain value $g_{kz}$ has been applied in the additional sub-band in question.

In the previous equation, $[GCED_{kz}]_{z=1}^{z=Z}x$ denotes the recombining of the additional sub-bands to which the gain values for the additional sub-bands in question have been applied.

The sub-step $A_2$ is then followed by a sub-step $A_3$ consisting in applying the delay to the recombined additional sub-bands and, in particular, to the spatially coded audio channels of corresponding index x by means of the delay $d_{kx}$ in a similar manner to the step A in FIG. 2*a*.

The corresponding operation is denoted by the equation:

$$CED_{kz}x=[GCED_{kz}]_{z=1}^{z=Z}x(d_{kx}).$$

Figure 2C:
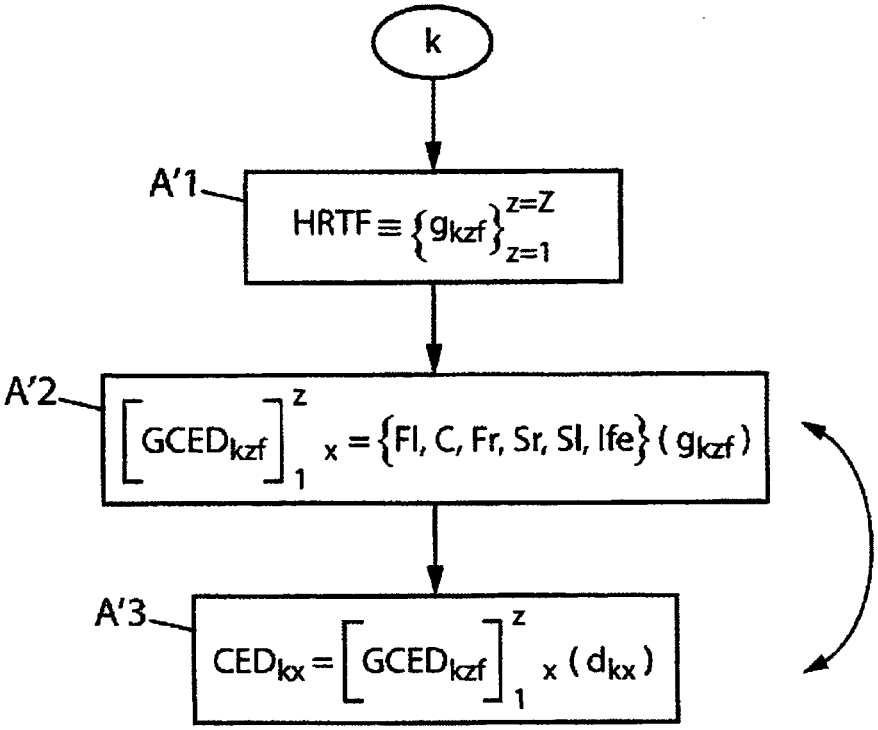
FIG. 2*c* shows, by way of illustration, one variant embodiment of the method, subject of the invention, shown in FIG. 2*a*, obtained by creation of additional sub-bands, in the presence of decimation.

Furthermore, the method, subject of the invention, can also consist in carrying out a filtering by equalization-delay in a hybrid transformed domain comprising an additional step for frequency division into additional sub-bands with decimation, as is shown in FIG. 2*c*.

In this scenario, the step $A'_1$ in FIG. 2*c* is identical to the step $A_1$ in FIG. 2*b*, for executing the creation of the additional sub-bands with decimation.

In this scenario, the decimation operation at the step $A'_1$ in FIG. 2*c* is executed in the time domain.

The step $A'_1$ is then followed by a step $A'_2$ corresponding to a recombining of the additional sub-bands to which the aforementioned gain values have been applied taking account of the decimation.

The recombining step $A'_2$ is itself preceded or followed by the application of the delay $d_{kx}$ as is represented by the double-headed arrow for interchange of the steps $A'_2$ and $A'_3$.

It will be understood, in particular, that, when the application of the delay is carried out prior to the recombining, the delay is applied directly to the signals of the additional sub-bands prior to the recombining.

As far as the conversion of each HRTF filter into a gain and delay value in the transformed domain is concerned, this operation can advantageously consist in associating as gain value, with each sub-band of rank k, a real value defined as the mean of the modulus of the corresponding HRTF filter and associating as delay value, with each sub-band of rank k, a delay value corresponding to the propagation delay between the left ear and the right ear of a listener for various positions.

Thus, using an HRTF filter, it is possible to calculate automatically the gains and the delay times applied in sub-band. Based on the frequency resolution of the HRTF filter bank, a delay value corresponding to the propagation delay between the left ear and the right ear of a listener for various positions is associated with each of the sub-bands $SB_k$.

Thus, using an HRTF filter, the gains and the delay times to be applied in sub-band can be automatically calculated.

Based on the frequency resolution of the filter bank, a real value is associated with each of the bands. By way of non-limiting example, starting from the modulus of the HRTF filter, the mean of the modulus of the aforementioned HRTF filter for each sub-band can be calculated. Such an operation is similar to an octave or Bark band analysis of the HRTF filters. Similarly, the delay to be applied for the indirect channels is determined, in other words the delay values which are more particularly applicable to the channels whose delay is not minimum. There exist numerous methods for automatically determining interaural delays, also denoted ITD for Interaural Time Difference, and which correspond to the delays between the left ear and the right ear, for various positions of the listener. By way of non-limiting example, the threshold method may be used which is described by S. Busson in his doctoral thesis from the Université de la Méditerranée Est-Marseille II, 2006, entitled "*Individualization of acoustic indices for binaural synthesis*". The principle of the methods for estimating the interaural delay of the threshold type is to determine the arrival time, or alternatively the initial delay of the wave on the right ear Td and on the left ear Tg. The interaural delay is given by the equation:

$$ITD \text{ threshold} = Td - Tg.$$

The most commonly used method estimates the arrival time as the moment when the HRIR temporal filter exceeds a given threshold. For example, the arrival time can correspond to the time for which the response of the HRIR filter reaches 10% of its maximum.

One example of specific implementation in the PQMF transformed domain will now be given hereinafter.

Generally speaking, it is stated that the application of a gain in the complex PQMF domain consists in multiplying the value of each sample of the sub-band signal, represented by a complex value, by the gain value formed by a real number.

Indeed, it is well known that employing a complex PQMF transformed domain allows the gains to be applied while avoiding the spectral aliasing problems generated by the under-sampling inherent to the banks of filters. Each sub-band $SB_k$ of each channel thus gets assigned a given gain.

In addition, the application of a delay in the PQMF transformed domain consists at least, for each sample of the sub-band signal, represented by a complex value, in introducing a rotation in the complex plane by multiplying this sample by a complex exponential value, function of the rank of the sub-band in question, of the under-sampling rate in the sub-band in question and of a delay parameter linked to the difference in interaural delay of a listener.

The rotation in the complex plane is then followed by a pure time delay of the sample after rotation. This pure time delay is a function of the difference in the interaural delay of a listener and of the under-sampling rate in the sub-band in question.

Practically speaking, it is stated that the aforementioned delays are applied to the resulting signals, in other words the equalized signals and, in particular, to the sub-sets of these signals or channels that do not benefit from a direct path.

In particular, the rotation is carried out in the form of a complex multiplication by an exponential value of the form:

$$\exp(-j*pi*(k+0.5)*d/M)$$

and by a pure delay implemented by a delay line, for example performing the operation:

$$y(k,n)=x(k, n-D)$$

In the preceding equations:

exp is the exponential function;

j is such that j*j=−1;

k the rank of the sub-band $SB_k$ in question;

M is the under-sampling rate in the sub-band in question; M should be taken equal to 64, for example;

y(k, n) is the value of the output sample after application of the pure delay on the time sample of rank n of the sub-band $SB_k$ of rank k, in other words the sample x(k,n) to which the delay B is applied;

d and D in the preceding equations are such that they correspond to the application of a delay of D*M+d in the non-under-sampled time domain. The delay D*M+d corresponds to the interaural delay previously calculated. d can take negative values which allows a phase advance to be simulated instead and in place of a delay.

The operation thus carried out leads to an approximation which is suitable for the effect sought.

In terms of calculation operations, the processing implemented therefore consists in carrying out a complex multiplication between a complex exponential and a sub-band sample formed by a complex value.

A delay is potentially to be inserted if the total delay to be applied is greater than the value M, but this operation does not comprise any arithmetic operations.

The method, subject of the invention, can also be implemented in a hybrid transformed domain. This hybrid transformed domain is a frequency domain in which the PQMF bands are advantageously re-divided up by a bank of filters, decimated or otherwise.

If the bank of filters is decimated, the decimation being understood to be a time decimation, then the introduction of a delay advantageously follows the procedure including a pure delay and a phase-shifter.

If the bank of filters is not decimated, the delay may then only be applied once during the synthesis. It is indeed pointless to apply the same delay on each of the branches because the synthesis is a linear operation, with no under-sampler.

The application of the gains remains identical, the latter simply being more numerous, such as previously described in conjunction with FIG. 2*b* for example, and therefore allow the higher precision frequency division to be followed. One real gain is then applied per additional sub-band.

Lastly, according to one variant embodiment, the method according to the invention is reiterated for at least two equalization-delay pairs and the signals obtained are summed so as to obtain the audio channels in the time domain.

A more detailed description of a device for sound spatialization of an audio scene comprising a first set comprising a number, greater than or equal to unity, of audio channels spatially coded over a given number of frequency sub-bands and decoded in a transformed domain, into a second set comprising a number, greater than or equal to 2, of audio channels for reproduction in the time domain, according to the object of the present invention, will now be described in conjunction with FIGS. 3*a* and 3*b*.

As was previously mentioned, the device, subject of the invention, is based on the principle of the conversion into the form of at least one gain and of a delay applicable in the transformed domain of filters for modeling the acoustic propagation of the audio signals of the aforementioned first set of channels. The device, subject of the invention, allows the sound spatialization of an audio scene, such as a 3D audio scene, into a second set comprising a number, greater than or equal to two, of audio channels for reproduction in the time domain.

Figure 3B:
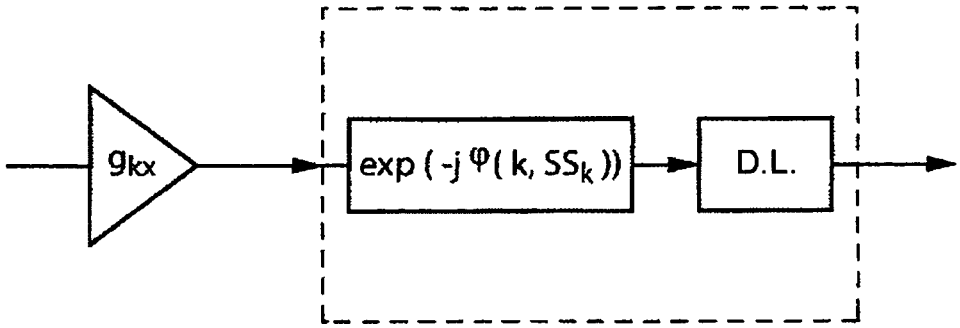
FIG. 3*b* shows, by way of illustration, an implementation detail of an equalization-delay filter allowing the implementation of the device, subject of the invention, shown in FIG. 3*a;*
Figure 3A:
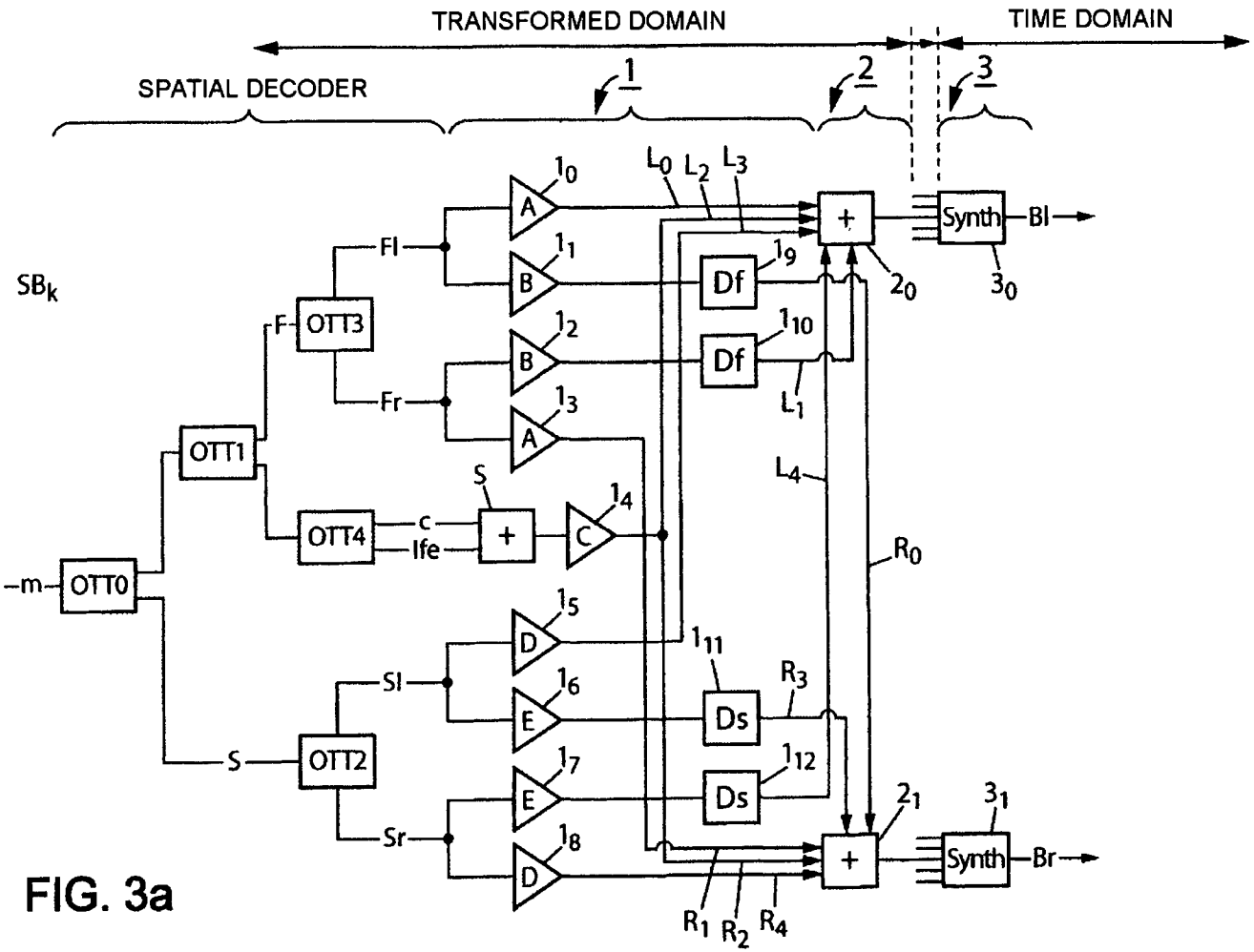
FIG. 3*a* shows, by way of illustration, a stage, for one frequency sub-band of a spatial decoder, of a sound spatialization device, subject of the invention.

The device, subject of the invention, shown in FIG. 3*a* relates to a stage of this device specific to each sub-band $SB_k$ of rank k for decoding in the transformed domain.

It will, in particular, be understood that the stage, for each sub-band of rank k shown in FIG. 3*a*, is in fact replicated for each of the sub-bands so as to finally form the sound spatialization device according to the subject of the present invention.

By convention, the stage shown in FIG. 3*a* will henceforth be denoted sound spatialization device, subject of the invention.

Figure 1C:
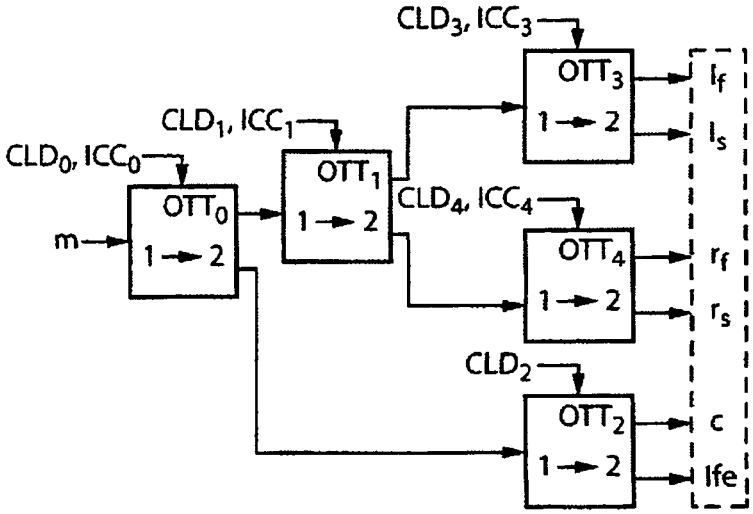
FIG. 1c (PRIOR ART)
Figure 1D:
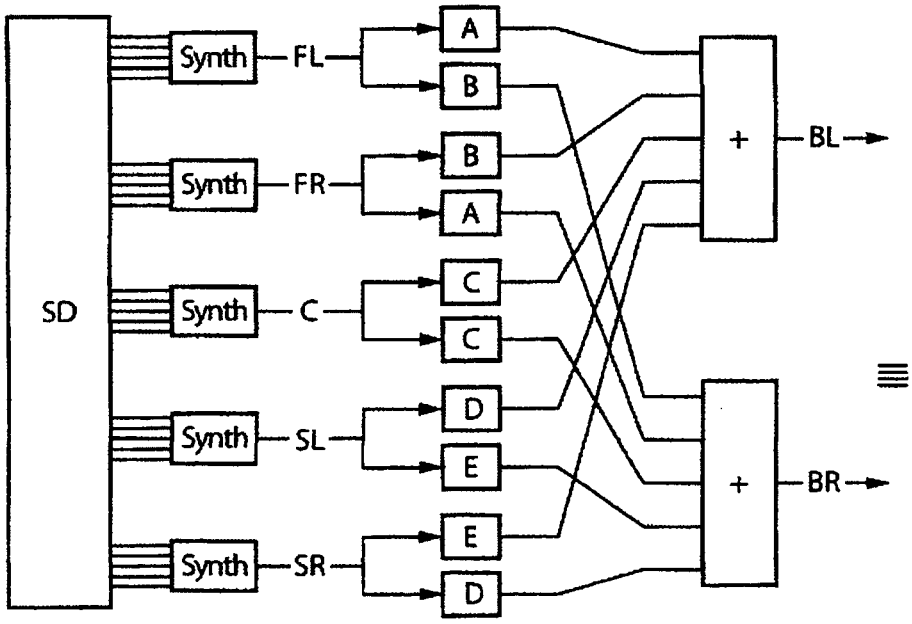
FIG. 1d (PRIOR ART)
Figure 1E:
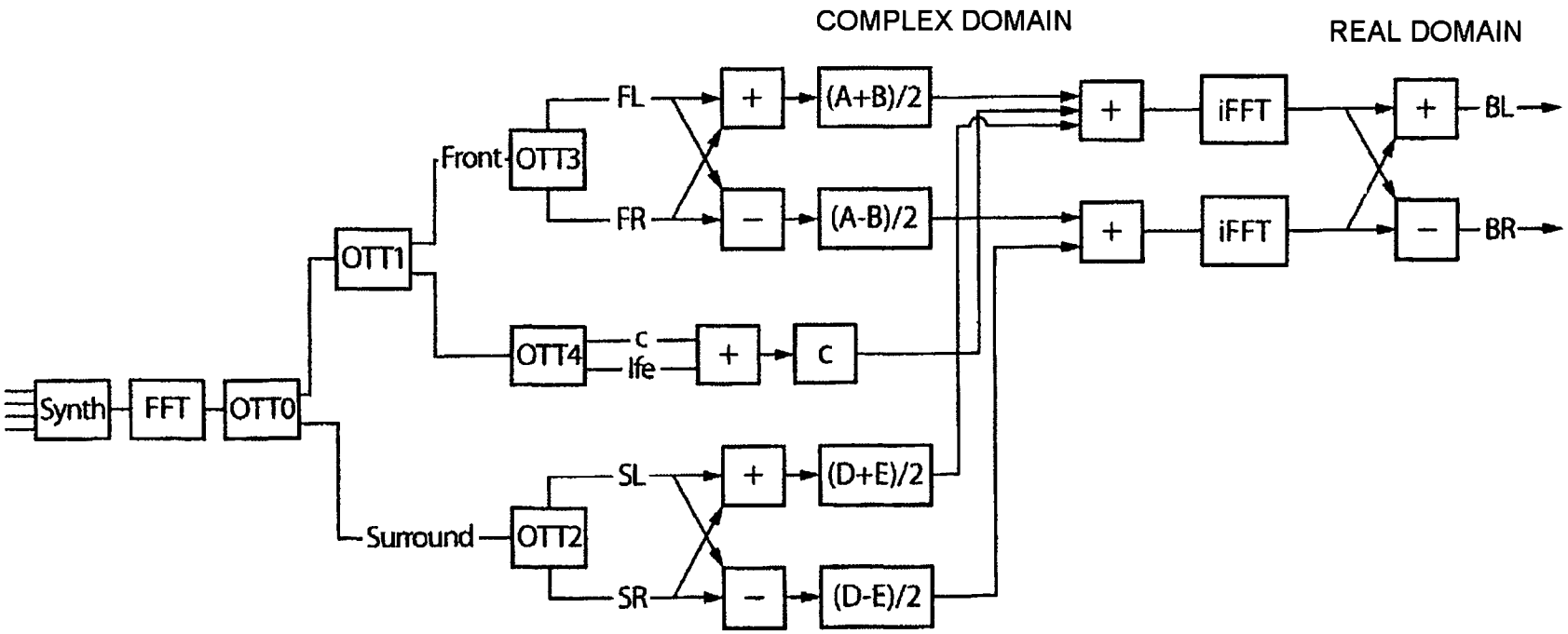
FIG. 1e (PRIOR ART)
Figure 1F:
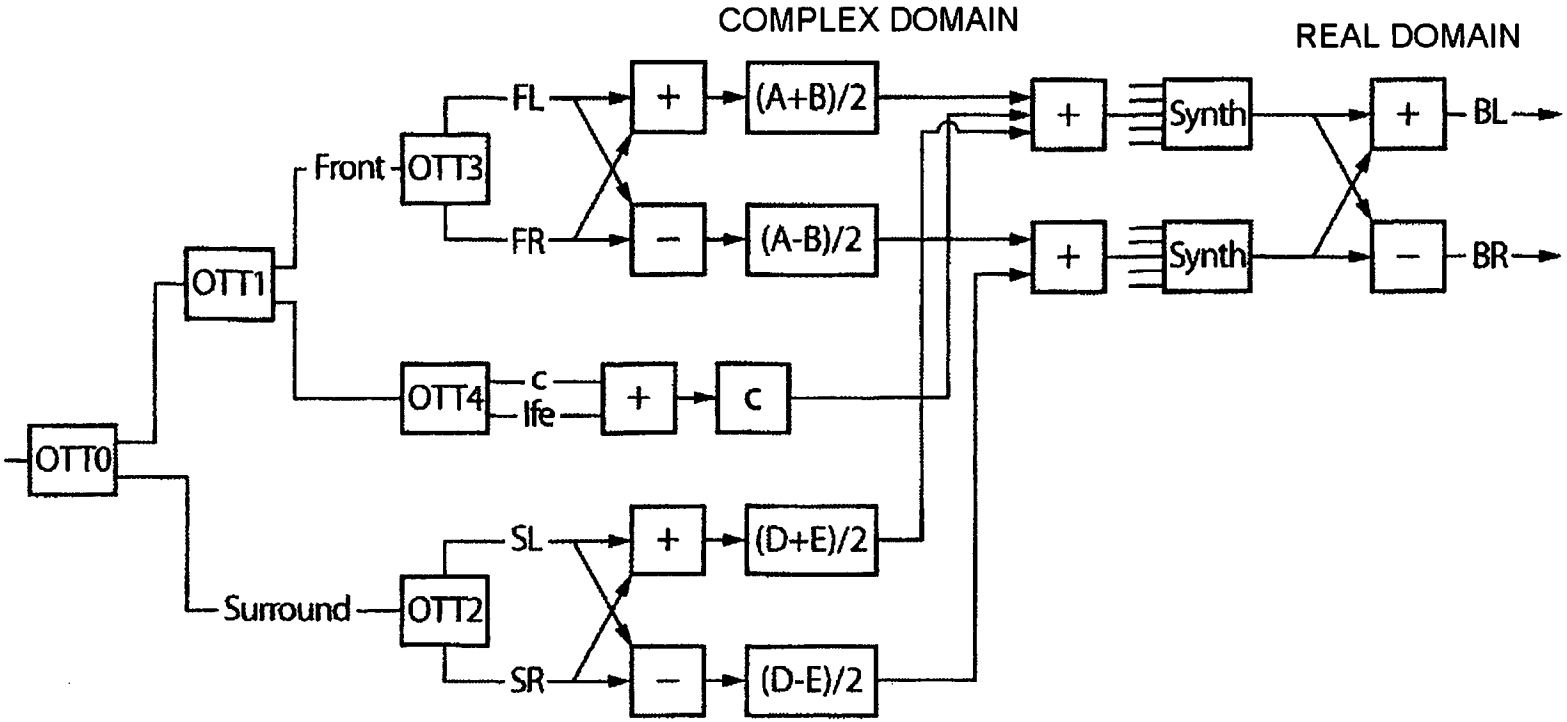
FIG. 1f (PRIOR ART)

With reference to the aforementioned figure, the device, subject of the invention, such as is shown in FIG. 3*a*, aside from the spatial decoder shown, comprises the modules $OTT_0$ to $OTT_4$ substantially corresponding to a spatial decoder SD of the prior art such as is shown in FIG. 1*c*, but in which a summation of the frontal channel C and of the low-frequency channel lfe is also applied, in a manner known per se in the prior art, by a summer S, and a module 1 for filtering by equalization-delay of the sub-band signal by application of a gain and a delay, respectively, to the sub-band signal.

In FIG. 3*a*, the application of a gain is shown on each of the spatially coded audio channels, represented by the amplifiers $\mathbf{1}_0$ to $\mathbf{1}_8$, the latter generating an equalized component which may or may not be subjected to a delay by means of delay elements denoted $\mathbf{1}_9$ to $\mathbf{1}_{12}$ in order to generate from each of the spatially coded audio channels a component equalized and delayed by a given delay value in the frequency sub-band $SB_k$.

With reference to FIG. 3*a*, the gains of the amplifiers $\mathbf{1}_0$ to $\mathbf{1}_8$ have arbitrary values A, B, B, A, C, D, E, E, D, respectively. In addition, the delay values applied by the delay modules $\mathbf{1}_9$ to $\mathbf{1}_{12}$ have the values Df, Bf, Ds, Ds. In the aforementioned figure, the structure of the gains and delays introduced is symmetrical. A non-symmetrical structure can be implemented without straying from the scope of the subject of the invention.

The device, subject of the invention, also comprises a module 2 for addition of a sub-set of equalized and delayed components in order to create a number of filtered signals in the transformed domain corresponding to the number N', greater than or equal to two, of the second set of audio channels for reproduction in the time domain.

Lastly, the device, subject of the invention, comprises a module 3 for synthesizing each of the filtered signals in the transformed domain in order to obtain the second set comprising a number N', greater than or equal to two, of audio signals for reproduction in the time domain. The synthesis module 3 thus comprises, in the embodiment in FIG. 3*a*, a synthesizer $\mathbf{3}_0$ and $\mathbf{3}_1$ which each allow an audio signal for reproduction in the time domain, $B_l$ for left binaural signal and $B_r$ for right binaural signal, respectively, to be delivered.

The equalized and delayed components in the embodiment in FIG. 3*a* are obtained in the manner hereinafter with:

A[k] denoting the gain of the amplifiers $\mathbf{1}_0$, $\mathbf{1}_3$ for the sub-band $SB_k$ of rank k, B[k] denotes the gain of the amplifier $\mathbf{1}_1$, $\mathbf{1}_2$ shown in FIG. 3*a*, C[k] denotes the gain of the amplifier $\mathbf{1}_4$, D[k] denotes the gain of the amplifiers $\mathbf{1}_5$, $\mathbf{1}_8$, E[k] denotes the gain of the amplifiers $\mathbf{1}_6$, $\mathbf{1}_7$.

As far as the spatially coded audio channels are concerned, and in particular these channels Fl, Fr, C, lfe, Sl and Sr for the sub-band $SB_k$, the n-th sample of the sub-band $SB_k$ is denoted by Fl[k][n], Fr[k][n], Fc[k][n], lfe[k][n], Sl[k][n], Sr[k][n]. Thus, each amplifier $\mathbf{1}_0$ to $\mathbf{1}_8$ successively delivers the following equalized components:

A[k]*Fl[k][n],
B[k]*Fl[k][n],
B[k]*Fr[k][n],
A[k]*Fr[k][n],
C[k]*Fc[k][n],
D[k]*Sl[k][n],
E[k]*Sl[k][n],
E[k]*Sr[k][n],
D[k]*Sr[k][n],

The preceding operations, as was previously mentioned in the description, are carried out in the form of a real multiplication acting, in this case, on complex numbers.

The delays introduced by the delay elements $\mathbf{1}_9$, $\mathbf{1}_{10}$, $\mathbf{1}_{11}$ and $\mathbf{1}_{12}$ are applied to the aforementioned equalized components in order to generate the equalized and delayed components.

In the example shown in FIG. 3*a*, these delays are applied to the sub-set that does not benefit from a direct path. In the description of FIG. 3*a*, these are the signals which have undergone multiplications by the gains B[k] and E[k] applied by the amplifiers or multipliers $\mathbf{1}_1$, $\mathbf{1}_2$, $\mathbf{1}_6$ and $\mathbf{1}_7$.

A more detailed description of a filter or element for filtering by equalization-delay formed for example by a multiplier amplifier $\mathbf{1}_1$ and a delaying element $\mathbf{1}_9$ will now be presented in conjunction with FIG. 3*b*.

As far as the application of the gain is concerned, it is stated that the corresponding filtering element, shown in FIG. 3*b*, comprises a digital multiplier, in other words one of the multipliers or amplifiers $\mathbf{1}_0$ to $\mathbf{1}_8$, represented by the gain value $g_{kx}$ in FIG. 3*b*, this multiplier allowing any complex sample from each coded audio channel of index x corresponding to the channels Fl, Fr, C, lfe, Sl or Sr to be multiplied by a real value, in other words the gain value previously mentioned in the description.

In addition, the filtering element shown in FIG. 3*b* comprises at least one complex digital multiplier, allowing a rotation to be introduced in the complex plane of any sample of the sub-band signal, for multiplying by a complex exponential value, the value $\exp(-j\phi(k,SS_k))$ where $\phi(k,SS_k)$ denotes a phase value, function of the under-sampling rate of the sub-band in question and of the rank of the sub-band in question k.

In one embodiment, $\phi(k,SS_k)=\phi*(k+0.5)*d/M$.

The complex digital multiplier is followed by a delay line denoted D.L. introducing a pure delay for each sample after rotation, allowing a pure time delay to be introduced that is a function of the difference of the interaural delay of a listener and of the under-sampling rate M in the sub-band $SB_k$ in question.

Thus, the delay line D.L. allows the delay to be introduced on the complex sample after rotation of the form y(k,n)=x(k, n−D).

Lastly, it is stated that the values of d and D are such that these values correspond to the application of a delay D*M+d in the unsampled time domain and that the delay D*M+d corresponds to the aforementioned interaural delay.

For the implementation of the device, subject of the invention, such as is shown in FIG. 3*a*, it can be observed that the signal Fr[k][n] is multiplied by the gain B[k] then delayed, which, in accordance with one of the noteworthy aspects of the subject of the invention, amounts to multiplying this signal by a complex gain. The product of the gain B[k] and the complex exponential can be performed once and for all, thus avoiding a complementary operation for each successive sample Fr[k][n]. The left equalized and delayed components are referenced $L_0$ to $L_4$ and the right $R_0$ to $R_4$ and are shown in the drawing combined by the summer modules $\mathbf{2}_0$ and $\mathbf{2}_1$, respectively, then verify the equations hereinafter:

TABLE T

| |
|---|
| L0[k][n] = A[k]Fl[k][n] |
| R0[k][n] = B[k]Fl[k][n] delayed by Df samples |
| R1[k][n] = A[k]Fr[k][n] |
| L1[k][n] = B[k]Fr[k][n] delayed by Df samples |
| L2[k][n] = R2[k][n] = C[k](Fc[k][n] + lfe[k][n]) |
| L3[k][n] = D[k]Sl[k][n] |
| R3[k][n] = E[k]Sl[k][n] delayed by Ds samples |
| R4[k][n] = D[k]Sr[k][n] |
| L4[k][n] = E[k]Sr[k][n] delayed by Ds samples |

In order to obtain the audio channels for reproduction in the time domain, namely the channels $B_l$ left and $B_r$ right, respectively, shown in FIG. 3*a*, in other words binauralized signals in the embodiment in FIG. 3*a*, for each sample of rank n, the equalized and delayed spatial components are added, in other words the addition of the components:

L0[k][n]+L1[k][n]+L2[k][n]+L3[k][n]+L4[k][n] for the summer module $\mathbf{2}_0$, and R0[k][n]+R1[k][n]+R2[k][n]+R3[k][n]+R4[k][n] for the summer module $\mathbf{2}_1$.

The resulting signals delivered by the summation modules $\mathbf{2}_0$ and $\mathbf{2}_1$ are then passed through the synthesizing filter banks $\mathbf{3}_0$ and $\mathbf{3}_1$, respectively, in order to obtain the binauralization signals in the time domain $B_l$ and $B_r$, respectively.

The aforementioned signals can then supply a digital-analog converter, in order to allow the left $B_l$ and right $B_r$ sounds to be heard on a pair of audio headphones for example.

The synthesizing operation carried out by the synthesizing modules $\mathbf{3}_0$ and $\mathbf{3}_1$ includes, where appropriate, the hybrid synthesizing operation such as was previously described in the description.

The method, subject of the invention, can advantageously consist in dissociating the equalization and delay operations, which may act on different numbers of frequency sub-bands. As a variant, the equalization may for example be carried out in the hybrid domain and the delay in the PQMF domain.

It will be understood that the method and the device, subjects of the invention, although described for the binauralization of six channels into a pair of headphones may also be applied in order to carry out a transauralization, in other words the reproduction of a 3D sound field on a pair of loudspeakers or in order to convert, in a relatively non-complex manner, a representation of N audio channels or sound sources coming from a spatial decoder or several monophonic decoders into N' audio channels available for the reproduction. The filtering operations may then be multiplied if required.

As a complementary non-limiting example, the method and the device, subjects of the invention, can be applied to the case of a 3D interactive game in the sounds emitted by the various objects or sound sources, which can then be spatialized as a function of their relative position with respect to the listener. Sound samples are then compressed and stored in various files or various memory areas. In order to be played and spatialized, they are partially decoded so as to remain in the coded domain and are filtered in the coded domain by suitable binaural filters advantageously using the method described according to the subject of the present invention.

Indeed, by combining the decoding and spatialization operations, the overall complexity of the process is greatly reduced without, however, resulting in any loss of quality.

Lastly, the invention covers a computer program comprising a series of instructions stored on a storage medium for execution by a computer or a dedicated sound spatialization device which, during this execution, executes the filtering, addition and synthesis steps such as were previously described in conjunction with FIGS. 2*a* to 2*c* and 3*a*, 3*b* in the description.

It will, in particular, be understood that the operations shown in the aforementioned figures may advantageously be implemented on complex digital samples by means of a central processing unit, a working memory and a program memory, not shown in the drawing in FIG. 3*a*.

Lastly, the calculation of the gains and of the delays forming the equalization-delay filters may be executed externally to the device, subject of the invention, shown in FIG. 3*a* and 3*b*, as will be described hereinafter in conjunction with FIG. 4.

With reference to the aforementioned figure, a first unit for spatial coding and for decoding with data rate reduction I is considered, including a device, subject of the invention, such as is shown in FIG. 3*a*, 3*b*, allowing the aforementioned spatial coding to be carried out, starting from an audio scene in 5.1 mode for example, and the coded audio transmission, on the one hand, and the transmission of spatial parameters, on the other, to a decoding and spatial decoding unit II.

The calculation of the equalization-delay filters can then be performed by a separate unit III which, using the modeling filters, HRTF filters, calculates the gain equalization and delay values and transmits them to the spatial coding unit I and to the spatial decoding unit II.

The spatial coding can thus take into account the HRTF which will be applied in order to correct its spatial parameters and to improve the 3D rendering. Similarly, the coder with data rate reduction will be able to use these HRTFs in order to measure the audible effects of frequency quantization.

In the decoding, it is the transmitted HRTFs that will be applied in the spatial decoder and that will allow, where appropriate, the reproduced channels to be reconstructed.

As in the previous examples, 2 channels starting from 5 will be reproduced, but other cases may include the construction of 5 channels starting from 3 as illustrated hereinabove. The spatial decoding method will then be applied as follows:

- projection of the 3 channels received onto a set of virtual channels (greater than the 5 output channels) using the spatial information (upmix);
- reduction of the virtual channels to the 5 output channels using the HRTFs.

If the HRTFs have been applied to the coder, then their contribution could optionally be eliminated prior to upmix in order to carry out the scheme hereinabove.

The HRTFs after conversion, in their form gain/delay, can preferably be quantized in the following form: coding in differential mode of their values, then quantization of their differences: if the values of the gains of the equalizer are denoted G[k], then the quantized values:

$$e[k]=G[k+1]-G[k]$$

will be transmitted in a linear or logarithmic manner.

Figure 4:
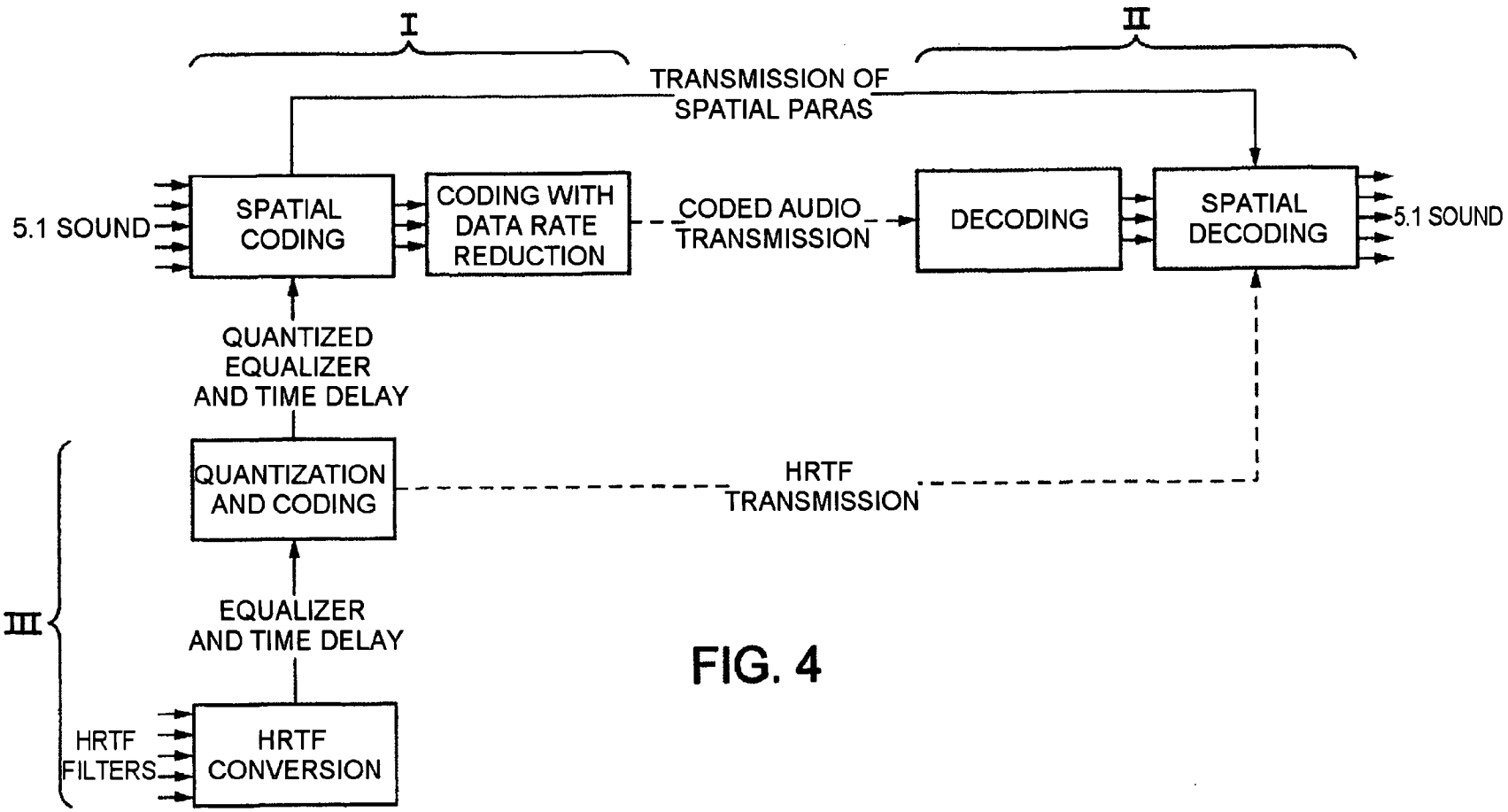
FIG. 4 shows, by way of illustration, one exemplary embodiment of the device, subject of the invention, in which the calculation of the equalization-delay filters is delocalized.

More specifically, with reference to the aforementioned FIG. 4, the process implemented by the device and the method, subjects of the invention, thus allows a sound spatialization of an audio scene to be executed in which the first set comprises a given number of spatially coded audio channels and the second set comprises a lower number of audio channels for reproduction in the time domain. It furthermore allows the decoding to perform an inverse transformation of a number of spatially coded audio channels into a set comprising a higher or equal number of audio channels for reproduction in the time domain.

The invention claimed is:

1. A method for sound spatialization of an audio scene comprising a first set comprising a number greater than or equal to unity of first audio channels spatially coded over a given number of frequency sub-bands, and decoded in a transformed domain, into a second set comprising a number greater than or equal to two of second audio channels for reproduction in the time domain, using Head Related Transfer Function (HRTF) filters modeling the acoustic propagation of audio signals corresponding to said first audio channels of said first set, wherein, each of said HRTF filters is converted into the form of at least a gain and a delay applicable in said transformed domain, and wherein said method includes, for each frequency sub-band of said transformed domain, at least:

the filtering by equalization-delay of the signal in sub-band by application of said gain and delay, respectively, on said sub-band signal, in order to generate, on the basis of the first audio channels, an equalized component delayed by a determined delay value in the frequency sub-band in question;

the addition of a sub-set of equalized and delayed components, in order to create a number of filtered signals in the transformed domain corresponding to the number in said second set greater than or equal to two, of said second audio channels for reproduction in the time domain;

the synthesis of each of the filtered signals in the transformed domain by a synthesizing filter, in order to obtain said second set with a number greater than or equal to two of audio channels for reproduction in the time domain;

and wherein said filtering by equalization-delay of the sub-band signal includes at least the application of an exponential of a phase shift related to a delay for at least one of the frequency sub-bands.

2. The method as claimed in claim 1, wherein said filtering by equalization-delay also includes a pure delay by storage for at least one of the frequency sub-bands.

3. The method as claimed in claim 1, wherein, in order to convert each of said HRTF filters into a gain value and, respectively, a delay value in the transformed domain, the latter consists at least in:

associating, as gain value, with each sub-band a real value defined as the mean of the modulus of the modeling HRTF filter;

associating, as delay value, with each sub-band a delay value corresponding to the propagation delay between the left ear and the right ear for various positions.

4. The method as claimed in claim 1, wherein the application of a gain in the PQMF domain consists in multiplying the value of each sample of the sub-band signal, represented by a complex value, by the gain value formed by a real number.

5. The method as claimed in claim 1, wherein the application of a gain in the PQMF domain consists at least, for each sample of the sub-band signal, represented by a complex value, in:

introducing a rotation in the complex plane by multiplication of this sample by a complex exponential value, function of the rank of the sub-band in question, of the under-sampling rate in the sub-band in question and of a delay parameter linked to the interaural delay difference of a listener;

introducing a pure time delay for the sample after rotation, said pure time delay being a function of the difference of the interaural delay of a listener and of the under-sampling rate in the sub-band in question.

6. The method as claimed in claim 1, wherein, for binaural sound spatialization of an audio scene in which the first set comprises a number of spatially coded audio channels equal to N=6, in 5.1 mode, said second set comprises two audio channels for reproduction in the time domain, for reproduction by a pair of audio headphones.

7. The method as claimed in one of claims 1 to 6, wherein the method is reiterated for at least two equalization-delay pairs and the signals obtained are summed in order to obtain the audio channels in the time domain.

8. The method as claimed in claim 1, wherein, for a sound spatialization of an audio scene in which the first set comprises a given number of spatially coded audio channels and the second set comprises a lower number of audio channels for reproduction in the time domain, in the decoding, this method consists in carrying out an inverse transformation of a number of spatially coded audio channels into a set comprising a greater or equal number of audio channels for reproduction in the time domain.

9. The method as claimed in claim 1, wherein the gain and delay values associated with the modeling HRTF filter are transmitted in a quantized form.

10. A non-transitory computer readable medium, comprising a series of instructions stored on a storage medium for execution by a computer or a dedicated device, wherein, during this execution, said program executes the filtering, addition and synthesis steps as claimed in claim 1.

11. A device for sound spatialization of an audio scene comprising a first set comprising a number greater than or equal to unity of first audio channels spatially coded over a given number of frequency sub-bands, and decoded in a transformed domain, into a second set comprising a number greater than or equal to two of second audio channels for reproduction in the time domain, using Head Related Transfer Function (HRTF) filters modeling the acoustic propagation of audio signals corresponding to said first channels of said first set wherein, for each frequency sub-band of a spatial decoder, in the transformed domain, said device comprises, aside from this spatial decoder:

means for filtering by equalization-delay of the signal in sub-band by application of at least a gain and a delay, respectively, on said sub-band signal, in order to generate from each of the first audio channels a component equalized and delayed by a given delay value in the frequency sub-band in question;

means for addition of a sub-set of equalized and delayed components, in order to create a number of filtered signals in the transformed domain corresponding to the number in said second set greater than or equal to two of said second audio channels for reproduction in the time domain;

means for synthesizing each of the filtered signals in the transformed domain, in order to obtain said second set comprising a number greater than or equal to two of audio signals for reproduction in the time domain;

and wherein said filtering by equalization-delay of the sub-band signal includes at least the application of an exponential of a phase shift related to a delay for at least one of the frequency sub-bands.

* * * * *

UNITED STATES PATENT AND TRADEMARK OFFICE

CERTIFICATE OF CORRECTION

PATENT NO. : 8,605,909 B2
APPLICATION NO. : 12/225677
DATED : December 10, 2013
INVENTOR(S) : Emerit et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1261 days.

Signed and Sealed this
Twenty-second Day of September, 2015

Michelle K. Lee

Michelle K. Lee
*Director of the United States Patent and Trademark Office*